US009873996B2

(12) United States Patent
Stackpoole et al.

(10) Patent No.: US 9,873,996 B2
(45) Date of Patent: Jan. 23, 2018

(54) DEVICE FOR MOVING CONSTRUCTION BARRELS AND CONES

(71) Applicant: Synergy Fabricated Innovations, LLC, Clinton Township, MI (US)

(72) Inventors: Matthew C. Stackpoole, Harrison Township, MI (US); Marcus J. Stackpoole, Harrison Township, MI (US)

(73) Assignee: SYNERGY FABRICATED INNOVATIONS, LLC, Clinton Township, MI (US)

( * ) Notice: Subject to any disclaimer, the term of this patent is extended or adjusted under 35 U.S.C. 154(b) by 201 days.

(21) Appl. No.: 14/613,077

(22) Filed: Feb. 3, 2015

(65) Prior Publication Data

US 2016/0222610 A1 Aug. 4, 2016

(51) Int. Cl.
*E01F 9/70* (2016.01)

(52) U.S. Cl.
CPC ..... *E01F 9/70* (2016.02)

(58) Field of Classification Search
CPC ... E01F 9/70; E01F 9/654; E01F 9/688; E02F 3/8152
USPC ..... 414/800; 37/381–393
See application file for complete search history.

(56) References Cited

U.S. PATENT DOCUMENTS 2,725,799 A * 12/1955 Day ..... E01C 19/15 172/199
2,748,508 A * 6/1956 Schiavi ..... E02F 3/80 172/438
3,065,556 A * 11/1962 Kampert ..... E01C 19/202 222/165
3,465,456 A * 9/1969 Meyer ..... E01H 1/105 15/245
4,710,053 A * 12/1987 Kulp ..... E01F 9/688 116/63 P
5,285,588 A * 2/1994 Niemela ..... E01H 5/065 37/232
5,611,157 A * 3/1997 Ferreira ..... E01H 5/061 172/701.1
6,056,498 A * 5/2000 Velinsky ..... E01F 9/70 414/501
6,237,258 B1 * 5/2001 Biro ..... B25G 3/38 294/53.5
6,357,578 B1 * 3/2002 Shelby ..... B60S 1/64 198/498
D702,583 S * 4/2014 Laflamme ..... D10/121
(Continued)

*Primary Examiner* — Anna M Momper
*Assistant Examiner* — Lynn E Schwenning
(74) *Attorney, Agent, or Firm* — Harness, Dickey & Pierce, P.L.C.

(57) ABSTRACT

A roadway marker moving device is provided for mounting to a vehicle and includes a support structure for mounting the device to a vehicle. The support structure is capable of being pivoted angularly relative to a longitudinal direction of travel of the vehicle. An elongated beam structure is mounted to the support structure and an elastomeric strip is mounted to a front face of the elongated beam structure for engaging the roadway marker. The angular orientation of the elongated beam can be adjusted while the vehicle is being driven with the elongated beam engaged with a roadway marker so that the positioning of the roadway marker can be controlled.

15 Claims, 5 Drawing Sheets

FIG.1

(56) References Cited

U.S. PATENT DOCUMENTS

| | | | | |
|---|---|---|---|---|
| 2003/0095835 | A1* | 5/2003 | Kulp | E01F 15/086 404/9 |
| 2004/0006895 | A1* | 1/2004 | Schultz | E01H 5/061 37/266 |
| 2005/0196257 | A1* | 9/2005 | Villeneuve | E01F 9/70 414/434 |
| 2016/0108589 | A1* | 4/2016 | Allega | E01F 9/70 414/800 |

* cited by examiner

DEVICE FOR MOVING CONSTRUCTION BARRELS AND CONES

FIELD

The present disclosure relates to a device for moving construction barrels and cones within roadways in order eliminate the need to have workers in the roadways for moving the barrels and cones.

BACKGROUND

This section provides background information related to the present disclosure which is not necessarily prior art.

Construction barrels and cones are utilized on road construction sites to direct vehicles in alternative routes or to safely deflect the traffic from construction work and workers. The construction zones can extend for several miles. As the construction work is completed for a given day, the barrels can be moved to the side of the road to allow the traffic to resume use of the temporarily closed-off lanes. On a subsequent day, the construction barrels and cones can be moved back into the roadway to provide a safe zone for construction work. This process can be repeated for several days, weeks or months. Typically, the movement of the construction barrels or cones has been performed by workers who manually move the construction barrels and cones into and out of position on a regular basis.

Published US Patent Application No. 2005/0196257A1 discloses a device for translocating roadway markers which is attached to the front end of a heavy-duty multi-ton vehicle. The device utilizes a transferring member that can be angled relative to the longitudinal direction of travel of the vehicle and includes a plurality of rollers disposed in a spaced relation along a length thereof for engaging construction barrels and trans-locating them from one side of the road to another. As the transferring member engages the barrels, the barrels move along the rollers from one side of the vehicle to another. The device of published US Patent Application No. 2005/0196257A1 is commercially available under the name Artec and although it works satisfactorily for moving construction barrels when the vehicle is driven at sufficiently low speeds, it is incapable of moving construction cones. Furthermore, the device is extremely heavy so that it can only be mounted to special heavy duty vehicles and the maximum speed of the vehicle is approximately 45 MPH when the device is lifted to an upright, non-use, position.

Accordingly, it is desirable to provide a device for reliably moving roadway markers, including construction cones and construction barrels, and which is relatively light weight so that it can be used with lighter weight vehicle and does not significantly inhibit the driving speed of the vehicle when the device is not in use.

SUMMARY

This section provides a general summary of the disclosure, and is not a comprehensive disclosure of its full scope or all of its features.

A roadway marker moving device is provided for mounting to a vehicle and includes a support structure for mounting the device to a vehicle. The support structure is capable of being pivoted angularly relative to a longitudinal direction of travel of the vehicle. An elongated beam structure is mounted to the support structure and defines a smooth straight front face for engaging the roadway marker. The angular orientation of the elongated beam can be adjusted while the vehicle is being driven with the elongated beam engaged with a roadway marker so that the positioning of the roadway marker can be controlled. According to a preferred embodiment, an elastomeric strip can be mounted to the elongated beam to define the smooth front face and provide a low coefficient of friction with a construction barrel or cone and provides a stable continuous surface for the barrel of cone to slide across.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
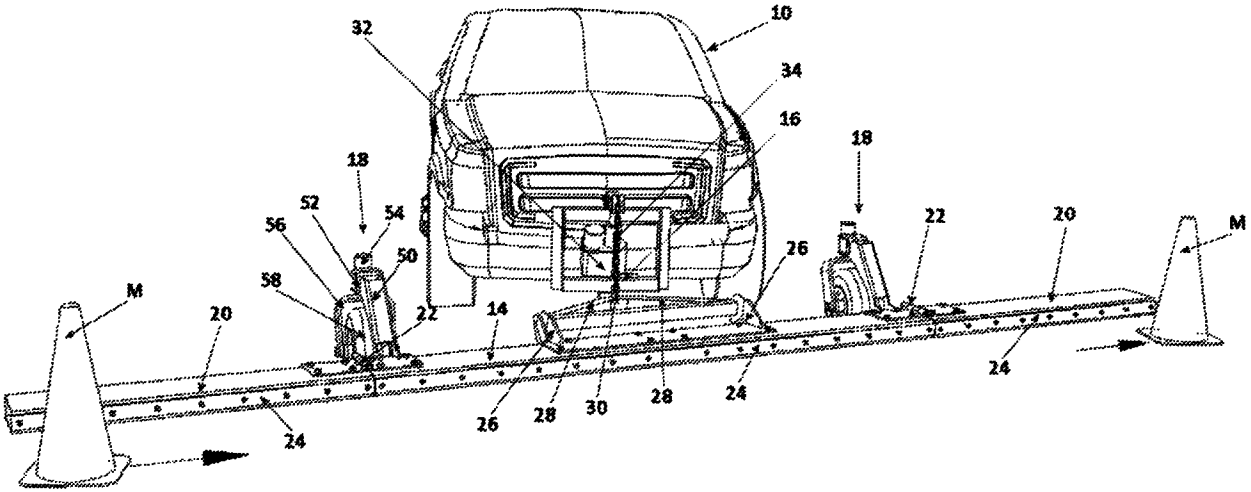
FIG. 1 is a perspective view of a vehicle equipped with a roadway marker moving device according to the principles of the present disclosure.
Figure 2:
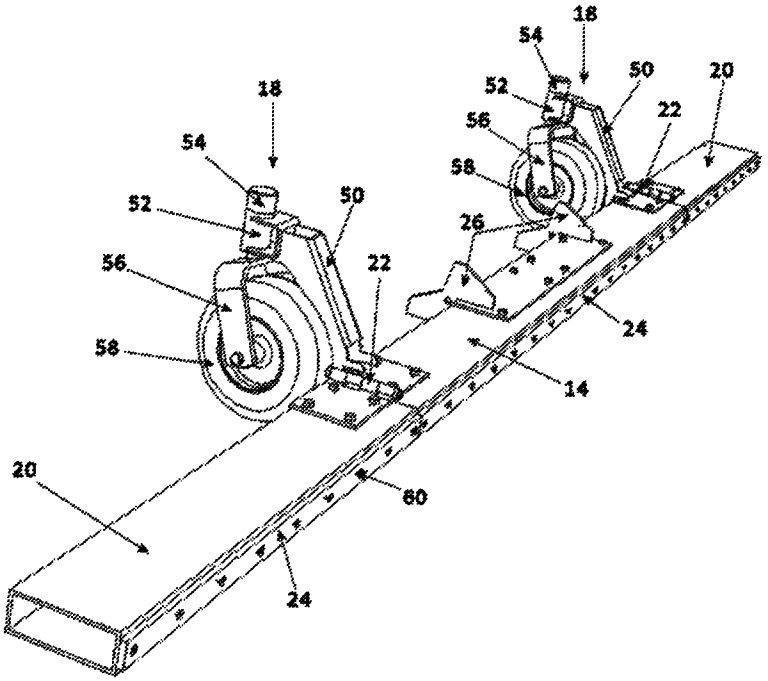
FIG. 2 is a perspective view of the roadway marker moving device according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a vehicle 10 is shown equipped with a roadway marker moving device 12 according to the principles of the present disclosure. Roadway marker moving device 12 includes an elongated beam 14 that is mounted to a position control mechanism 16. A pair of caster wheels 18 are mounted at opposite ends of the elongated beam 14. A pair of extension beams 20 can be pivotally mounted to the ends of the elongated beam 14 by a hinge 22. The elongated beam 14 and the pair of extension beams 20 each define a smooth straight contact surface. The smooth straight contact surface can include an elastomeric strip 24 secured to a front of the elongated beam 14 and the pair of extension beams 20. Alternatively, the smooth straight contact surface can be made from metal, plastic or other material. The material can be coated with a low friction material such as silicone.

Figure 4:
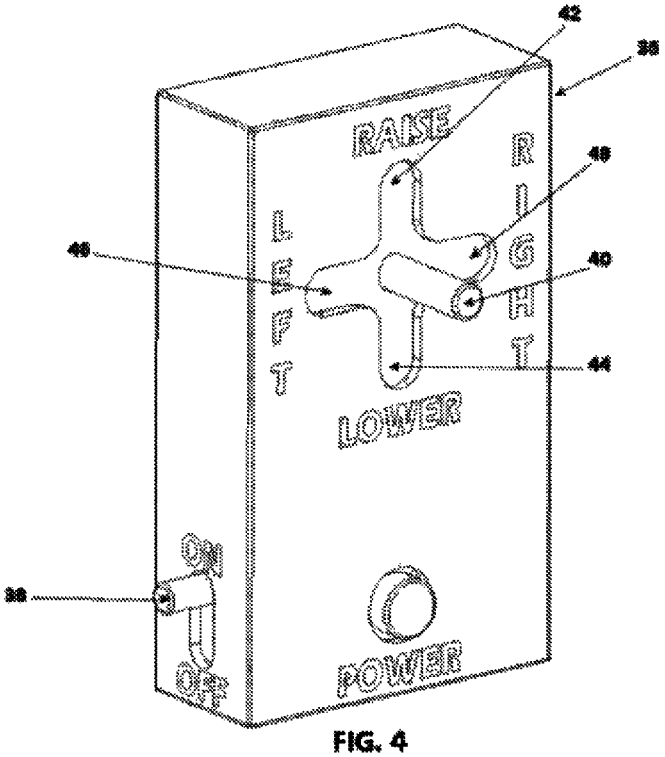
FIG. 4 is a plan view of an in-cab control device for controlling an angular position as well as the raising and lowering of the roadway marker moving device according to the principles of the present disclosure.

The elongated beam 14 can include a mounting structure such as a pair of mounting brackets 26 that are used for mounting the elongated beam 14 to the position control mechanism 16. The position control mechanism 16 can be in the form of a conventional plow control mechanism that includes a pair of arms 28 that engage the mounting brackets 26. The pair of arms 28 are engaged with a platform 30 that can be manipulated by a pivot device 32 and a lift device 34 that are commonly used for a conventional plow control mechanism. The position control mechanism 16 can be controlled by an operator within the cab of the vehicle 10 utilizing a control device 36 such as the one disclosed in FIG. 4. The control device 36 can include an on-off switch 38 as well as a joystick 40 that can be moved between raised and lowered positions 42, 44 as well as left and right positions 46, 48. The control device 36 can be hardwired or wirelessly in communication with the position control mechanism 16 for activating the lift device 34 and/or pivot device 32 as is generally known with a conventional plow.

The pair of caster wheels 18 are mounted at opposite ends of the elongated beam 14 and include a frame structure 50 that include a pivot mount 52 for receiving a pivot 54 of a wheel mount 56 that rotatably supports the wheels 58. Caster wheels 18 allow the wheels 58 to pivot in the longitudinal direction of travel of the vehicle as the angular orientation of the roadway marker moving device 12 is angularly adjusted relative to the longitudinal direction of travel of the vehicle 10.

Figure 3:
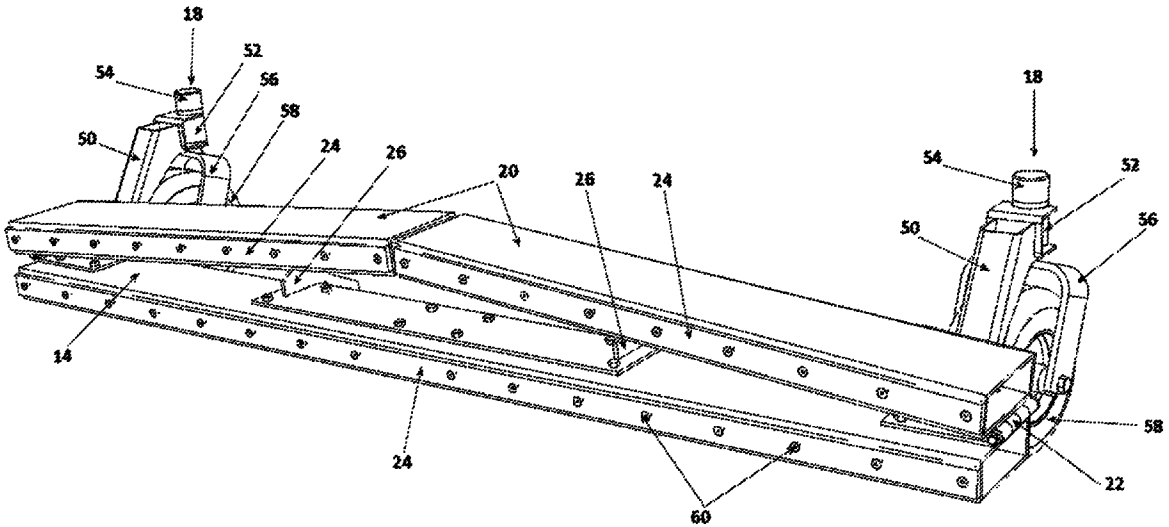
FIG. 3 is a perspective view of the roadway marker moving device shown with the extension beams in a folded position.
Figure 5:
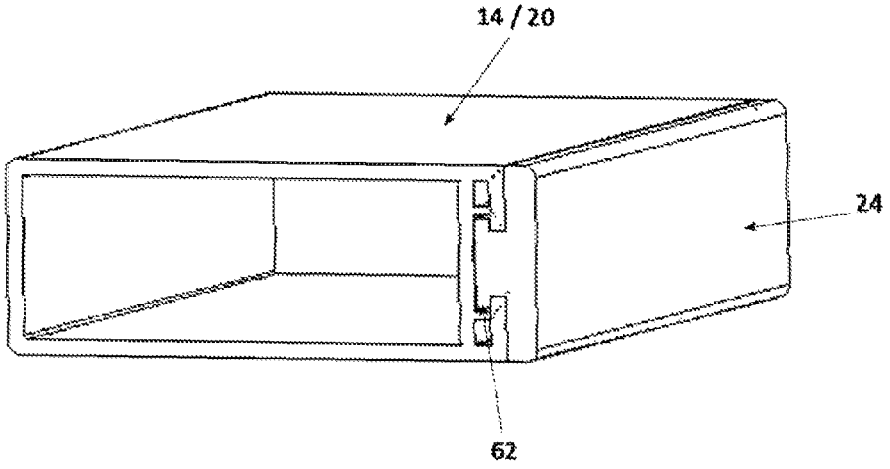
FIG. 5 shows the elastomeric strip secured to the beams via a support channel.

The elastomeric strips 24 can be mounted to the front surface of the elongated beam 14 and extension beams 20 by recessed fasteners 60 or can be secured by an adhesive, the strips 24 can be slid into a support channel 62 (as shown in FIG. 5) or other known fastening techniques can be used. The elastomeric strips 24 can be preferably made from a urethane material, polyethylene, ultra-high-molecular-weight (UHMW) polyethylene or similar material that resists scratches and provides a very low coefficient of friction when engaged with a roadway marker such as a construction barrel or cone The elongated beam 14 can be of a preselected length such as, for example, 8 feet in width. In addition, the extension beams 20 can be provided with a preselected length such as, for example, 4 feet in width, so that the moving device 12 can be utilized in selected lengths of 8 feet, 12 feet and 16 feet with selected ones of the extension beams 20 being placed in use or folded out of use as illustrated in FIG. 3. The lengths of the elongated beam 14 and extension beams 20 can be varied depending upon a particular desired use. The elongated beam 14 and the extension beams 20 can be formed from metal, such as steel or aluminum or other rigid materials and can include a hollow rectangular cross-section or other configurations. A vertical height of the beams 14, 20 can be between 2 and 5 inches. A vertical height of the elastomeric strips 24 that are mounted to the beams 14, 20 can be between 1 and 3 inches.

During operation, the roadway marker moving device 12 is lowered so that the wheels 58 engage the ground and support the elongated beam 14, and if desired the extension beams 20 at a position of between 1 and 10 inches above the ground, and more particularly, approximately 6 inches above the ground. The roadway marker moving device 12 is angled relative to a direction of travel of the vehicle and brought into engagement with a roadway marker M such as a construction barrel or cone. The vehicle 10 can be driven at speeds of up to 20 miles per hour to cause the roadway marker M to traverse across the angled moving device 12 from one side of the vehicle to the other until the roadway marker M is disposed to a side of the roadway marker moving device 12. It is noted that the angular position of the moving device 12 can be adjusted using the control device 36 while the vehicle is traveling in the longitudinal direction to cause the roadway marker M to be maintained along the moving device 12 for longer or shorter periods of time so that the position of the roadway markers longitudinally relative to the direction of travel of the vehicle can be selected by the user.

It is noted that construction barrels and cones can be provided with a weighted base (sometimes in the form of a tire ring) which surrounds a bottom portion of the barrels and cones to weigh down the bottom portion to stabilize the barrel in high winds and when bumped. Construction barrels are generally larger in diameter than construction cones. Construction barrels have generally been standardized to have a height of approximately 36 inches and a width of approximately 23 inches. Construction cones can be of various heights typically ranging from 12-36 inches and having a base which is typically less than 16 inches wide. During testing, the roadway marker moving device 12 according to the present disclosure has been shown to be effective at moving both construction barrels and construction cones while the vehicle is being driven at moderate speeds ranging from 1-20 miles per hour, and more preferably 1-15 miles per hour.

In contrast, the device as disclosed in US published application No. 2005/0196257 has been shown only to be effective for moving construction barrels and not cones and requires that the vehicle be driven at significantly lower speeds while moving barrels, than the roadway marker moving device 12 of the present disclosure.

When the roadway marker moving device 12 is not in use, the extension beams 20 can be moved to the non-use position as shown in FIG. 3 and the lift device 34 of the position control mechanism 16 can be operated via the control device 36 to lift the roadway marker moving device 12 off of the ground. The lightweight construction of the hollow elongated beam 14 and extension beams 20 allows the vehicle 10 to be a standard pickup truck (for example a half-ton pickup truck) that can be driven at normal posted speeds without being inhibited by the lifting device 12 when it is not in use. Accordingly, the roadway marker moving device 12 according to the present disclosure provides greater functionality at a significantly reduced cost and with more readily available vehicles than the system disclosed in US Published Application No. 2005/019625A17. The roadway marker moving device 12 therefore provides a much lower cost alternative to moving roadway markers of various types while keeping workers off of the roads to enhance worker safety.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A roadway marker moving device for mounting to a vehicle, comprising:

a support structure for mounting the device to a vehicle, the support structure including at least one mounting bracket connected to a vehicle-mounted lift device and pivot device being capable of pivoting the support structure angularly relative to a longitudinal direction of travel of the vehicle;

an elongated beam structure mounted to the support structure with the elongated beam defining a flat smooth straight contact surface for engaging the roadway maker, wherein said support structure includes at least one wheel that supports the elongated beam structure at a position between 1 and 10 inches above a road surface and said flat smooth straight contact surface of said elongated beam includes an elastomeric strip secured to the elongated beam that, during use to move roadway markers is not in contact with the road surface.

2. The device according to claim 1, wherein said elastomeric strip is made from one of urethane, polyethylene and ultra-high-molecular-weight (UHMW) polyethylene.

3. The device according to claim 1, wherein the at least one wheel includes a pair of wheels mounted to said elongated beam for supporting said elongated beam between 4 and 8 inches above the road surface.

4. The device according to claim 1, wherein said elastomeric strip has a height in a vertical direction of between 1 and 3 inches.

5. The device according to claim 1, wherein said elongated beam has a length of at least 7 feet and a height in a vertical direction of between 2 and 5 inches.

6. The device according to claim 1, further comprising a pair of extension beams pivotally attached to opposite ends of said elongated beam, said pair of extension beams each including an elastomeric strip mounted to a front face thereof.

7. The device according to claim 1, further comprising control means for adjusting an angular orientation of the elongated beam relative to the longitudinal direction of travel of the vehicle.

8. A method of moving roadway markers using a vehicle, comprising the steps of:

mounting an elongated beam structure to a vehicle by at least one mounting bracket connected to a vehicle-mounted lift device and a vehicle-mounted pivot device, said elongated beam structure being further supported by at least one wheel;

supporting the elongated beam structure angularly relative to a longitudinal direction of travel of the vehicle and between 1 and 10 inches above a road surface said elongated beam structure having a flat smooth straight contact surface on a front face thereof, wherein said flat smooth straight contact surface is formed by an elastomeric strip secured to the elongated beam that, during use to move a roadway marker is not in contact with a road surface;

driving the vehicle in the longitudinal direction of travel of the vehicle to engage the roadway marker with the smooth straight contact surface; and proceeding to drive in the longitudinal direction to cause said roadway marker to slide laterally across the smooth straight contact surface and to deposit the roadway marker at a desired location at a lateral side of the vehicle.

9. The method according to claim 8, wherein said elastomeric strip is made from one of urethane, polyethylene and ultra-high-molecular-weight (UHMW) polyethylene.

10. The method according to claim 8, wherein said roadway marker is a construction cone having a base section with a width of less than 20 inches in diameter.

11. The method according to claim 8, wherein said roadway marker is a construction barrel having a base section with a width of at least 20 inches in diameter.

12. The method according to claim 8, further comprising adjusting an angular position of the elongated beam while driving the vehicle in the longitudinal direction so that the positioning of the roadway marker can be controlled.

13. The method according to claim 8, wherein said smooth straight contact surface has a height in a vertical direction of between 1 and 3 inches.

14. The method according to claim 8, wherein said elongated beam includes a pair of extension beams pivotally attached to opposite ends of said elongated beam.

15. The method according to claim 14, wherein said pair of extension beams each including an elastomeric strip mounted to a front face thereof.

* * * * *